US006324711B1

(12) United States Patent
Wells

(10) Patent No.: US 6,324,711 B1
(45) Date of Patent: Dec. 4, 2001

(54) LOW DENSITY SPRING ASSEMBLY AND METHOD OF MAKING LOW DENSITY SPRING ASSEMBLIES

(75) Inventor: Thomas J. Wells, Carthage, MO (US)

(73) Assignee: L&P Property Management Company, Southgate, CA (US)

( * ) Notice: Subject to any disclaimer, the term of this patent is extended or adjusted under 35 U.S.C. 154(b) by 0 days.

(21) Appl. No.: 09/534,779

(22) Filed: Mar. 24, 2000

(51) Int. Cl.[7] ..... A47C 23/04

(52) U.S. Cl. ..... 5/716; 5/655.7; 5/248; 5/256

(58) Field of Search ..... 5/716, 727, 655.7, 5/248, 256; 297/452.51; 267/91, 92, 96; 140/92.3, 92.4, 92.7, 92.8

(56) References Cited

U.S. PATENT DOCUMENTS

| | | | | |
|---|---|---|---|---|
| 125,250 | | 4/1872 | Andrews . | |
| 426,022 | | 4/1890 | Jeffery . | |
| 1,860,642 | | 5/1932 | Zimmerman . | |
| 1,866,664 | | 7/1932 | Munn . | |
| 3,916,464 | | 11/1975 | Tyhanic . | |
| 4,236,262 | * | 12/1980 | Spiller | 5/267 |
| 4,426,070 | * | 1/1984 | Garceau et al. | 5/267 |
| 5,184,802 | * | 2/1993 | Galumbeck | 5/267 |
| 5,579,810 | | 12/1996 | Ramsey et al. . | |
| 5,584,083 | * | 12/1996 | Ramsey et al. | 5/271 |
| 5,701,653 | * | 12/1997 | Rupe | 5/236.1 |

FOREIGN PATENT DOCUMENTS

| | | |
|---|---|---|
| 165465 | 2/1934 | (CH) . |
| 793155 | 11/1935 | (FR) . |

* cited by examiner

*Primary Examiner*—Lynne H. Browne
*Assistant Examiner*—Fredrick Conley
(74) *Attorney, Agent, or Firm*—Wood, Herron & Evans, L.L.P.

(57) ABSTRACT

A method of making low density spring interior assemblies having rectangular arrays of spring positions, some of which are occupied by individual coil springs and some of which are empty, is provided. Preferably, the array is formed of rows of alternating springs and empty positions laced to similar rows offset from each other in a staggered arrangement so that spaces and springs alternate both transversely and longitudinally. Preferably the springs are unknotted. The assemblies are automatically formed on a system that includes at least one coil former, at least one conveyor, a transfer station or mechanism and a spring interior assembly machine. A coil former forms and loads springs individually onto a conveyor. The transfer station transfers rows of coils to the assembly machine, which laces rows of coils together in the array. The coil formers, conveyors, transfer station and assembly machine may be conventional, with at least one controlled to create empty positions and determine the relative locations of springs and empty positions. In some embodiments, coils may be placed at spaced locations on a conveyor to create the empty positions, either by controlling the timing of the coil former or controlling the indexing of the conveyor, while in other embodiments, the transfer station or assembler may space the springs prior to transfer or lacing. One or more of the elements of the system may be controlled to stagger the rows, either before, during or after transfer to the assembler. One or multiple conveyors may be timed or arranged so that different rows are presented to the transfer station in different offset positions.

6 Claims, 4 Drawing Sheets

LOW DENSITY SPRING ASSEMBLY AND METHOD OF MAKING LOW DENSITY SPRING ASSEMBLIES

The present invention relates to the manufacture of spring assemblies, and more particularly to the manufacture of low density mattress spring assemblies, particularly assemblies of widely spaced unknotted coils.

BACKGROUND OF THE INVENTION

Spring assemblies or spring interiors such as those used in inner spring mattresses are usually made of rectangular arrays of individually coiled springs linked together with transverse coils of lacing wire. These assemblies are presently made on automated machinery that includes one or more coil forming machines or coilers, a coil collecting conveyor, a coil row transfer device and a coil row assembler. The coil machines produce individual coils and place them on the conveyor. The conveyor collects and then conveys rows of coils, one row at a time, to the row transfer machine. The row transfer machine transfers the rows of coils, one row at a time, transversely into an assembly machine which laces the rows together to form a rectangular array that becomes the spring interior assembly of an inner spring mattress. Systems for making these assemblies are described in U.S. Pat. Nos. 3,386,561; 3,774,652; 4,111,241; 4,413,659; 4,705,079; 5,579,810 and 5,934,339, which are all hereby expressly incorporated herein by reference.

In the automatic production of these spring assemblies, manufacture of rectangular arrays is the easiest, and the spring assembly making machinery is typically configured to assemble spring interiors in these rectangular arrays. Where softer mattresses are desired to be made, the convenient way of doing so is to use softer springs in the arrays.

Before the automated manufacture of spring assemblies became dominant, when spring interiors were assembled by hand, relatively soft spring units were often made by hand lacing coils with spaces between adjacent coils of a row so that few coils per unit area of mattress were present. Early spring assemblies made of low density arrays of unknotted coils are described, for example, in the 1934 Swiss Patent No. 165465 to Büron and in the 1935 French Patent No. 793.155 to Simmons. The absence of knos to secure the ends of the wire of the coils presents few problems when units are assembled by hand. When machines became common for assembling spring interiors, unknotted coils were found to be dimensionally unstable and difficult to handle with automated gripper devices, and arrangements of coils at widely spaced intervals were not compatible with the machinery.

Therefore, there is a need for a method and machinery for the automated assembly of spring interiors for mattresses that have low density arrays of individual coil springs, particularly coil springs without knotted wire ends.

SUMMARY OF THE INVENTION

A primary objective of the present invention is to provide a spring interior assembly method and apparatus for producing low density spring assemblies, particularly assemblies of unknotted springs.

A further objective of the invention is to provide a method and machinery having flexibility in the spacing of springs allowing low density spring assemblies to be produced on machinery designed to produce spring assemblies formed of rectangular arrays of knotted coil springs. A more particular objective of the invention is to provide a method of making low density spring assemblies with a minimum of alteration to existing equipment that has been provided for making assemblies of springs in rectangular arrays.

In accordance with the principles of the present invention, a spring interior assembling method is provided having four components, including one or more spring formers or coilers, a conveyor, a row transfer station and a spring interior assembler. The components are preferably the same as would be included in a conventional spring interior assembly line on which standard assemblies are made having rectangular arrays of springs, but with at least one difference. The difference results in empty spaces in the array where springs would otherwise be located. One or more of the components differs from the corresponding component of the conventional machine.

In one embodiment, a spring coiler is controlled to execute some cycles in which a coil spring is formed and delivered to the conveyor. In other cycles, an idle cycle is executed in which no spring is delivered to the conveyor. Preferably, alternating productive and nonproductive cycles are executed by the coiler to deliver springs to alternate positions on the conveyor. The conveyor indexes once per cycle so that empty locations appear on the conveyor when no spring is delivered in a cycle of the coiler. As a result, with only a change to the control of the coiler, all of the other components of a standard spring assembly line can remain unchanged. The same line can be selectively controlled to produce either regular or low density assemblies.

In another embodiment, the coiler is made to operate at its normal rate, but additional index commands are sent to the conveyor. When producing a coil row having coils at alternate locations, two index pulses can be sent to the conveyor control for each coil produced, so that an empty space exists on the conveyor following each coil placed on the conveyor.

In other embodiments, along with either of the embodiments above, one or more additional indexing signals may be communicated to the conveyor so that the row of coils and spaces on the conveyor aligns differently with the assembler at the transfer station. For example, where staggered rows of alternate coils and spaces are to be assembled, one row is moved by the conveyor to the transfer station with its coils in odd numbered positions. Then, the next row is moved to the transfer station with its coils in even numbered positions. Alternatively, two parallel conveyors can be used, with coils on one conveyor fed in a staggered relationship to the coils on the other conveyor, with both rows being transferred to the assembler simultaneously at the transfer station.

Alternative to the embodiments discussed in the paragraph immediately above in which the conveyor is differently indexed to shift one row relative to another, the transfer station may cooperate with the assembler to selectively shift rows of coils to differently align the coils and spaces. In a further alternative, the coils can be produced and fed to the conveyor, one at each position on the conveyor, with fewer coils than the number of positions in a row, and the transfer station and assembler can cooperate to spread the coils along the entire row while creating empty positions.

These and other configurations, objectives and advantages of the present invention will be more readily apparent from the following detailed description of the drawings and preferred embodiments, in which:

DETAILED DESCRIPTION OF THE PREFERRED EMBODIMENTS

Figure 1:
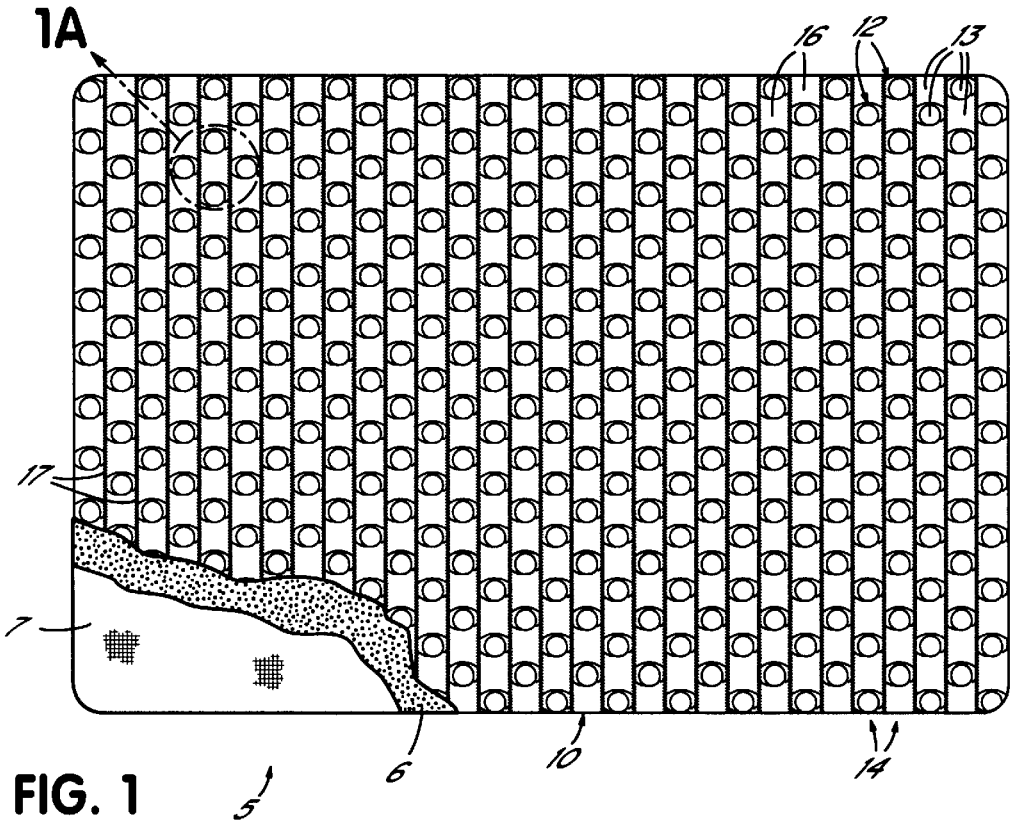
FIG. 1 is a top view of a mattress having a mattress spring interior assembly which can be manufactured according the present invention.
Figure 1A:
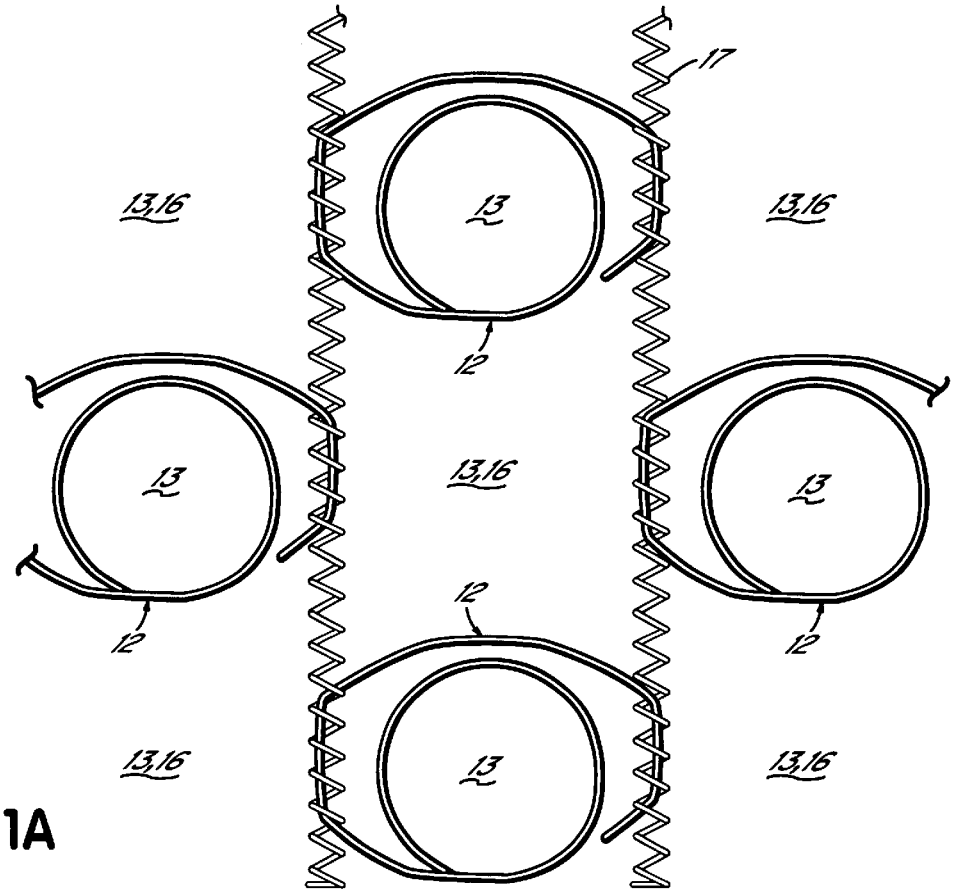
FIG. 1A is an enlarged view of the circled portion of FIG. 1 so marked.

FIGS. 1 and 1A illustrate a mattress 5 having low density mattress spring interior assembly 10 covered by conventional padding 6 and encased in an upholstered covering 7. A low density spring interior assembly is one in which fewer coils are present than in a standard mattress, usually for the purpose of producing a less stiff or less firm mattress. In the spring interior assembly 10, 390 individual springs 12 are laced together in a rectangular array or grid that contains 780 possible spring positions 13 so that the low density assembly 10 has half as many coils 12 as would be present in a mattress spring assembly of standard density using the same type of springs 12. The grid positions 13 are the x and y positions of a rectangular x-y grid or array. The springs 12 of the assembly are arranged in thirty rows 14, each containing twenty-six of the spring positions 13. Each row 14 has thirteen springs 12, occupying alternate ones of the positions 13 and leaving thirteen spaces or empty positions 16 in each row. The springs 12 of adjacent rows 14 are laced together with coils of lacing wire 17, which also hold together adjacent springs 12 of the same rows. The springs 12 of adjacent rows 14 are staggered or displaced one position 13 from the springs 12 of adjacent rows 14.

Figure 2:
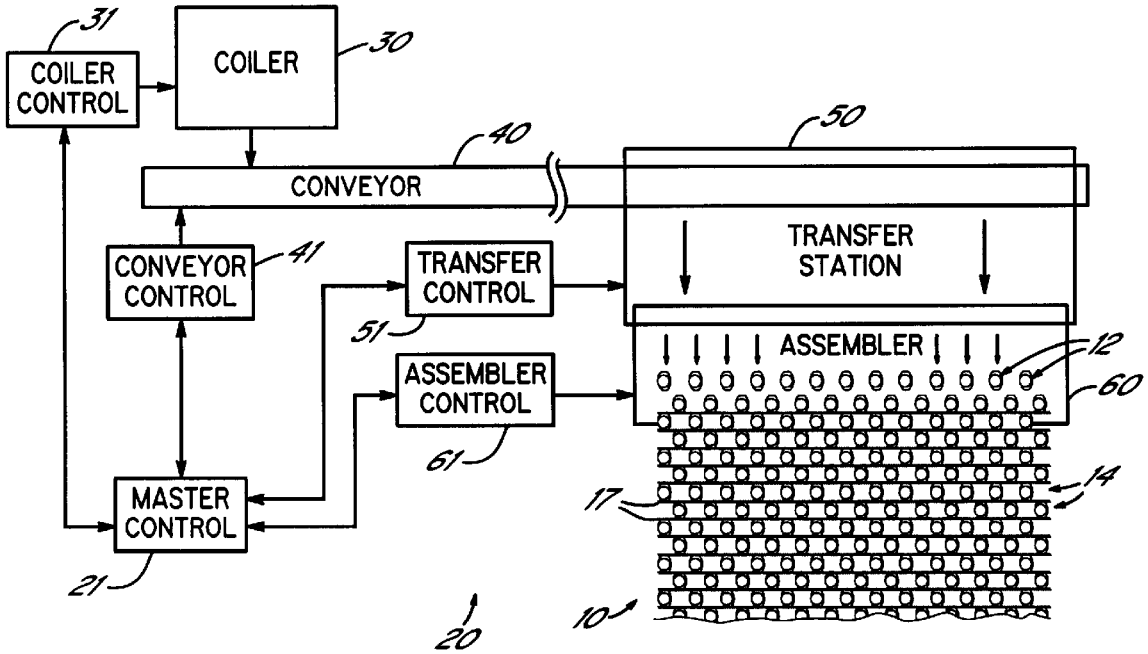
FIG. 2 is a diagrammatic representation of a mattress spring interior assembly system for producing the mattress spring interior assembly of FIG. 1.

A low density spring interior assembly 10 is manufactured on a spring interior assembly production line 20, as illustrated in FIG. 2. The production line 20 has components that include one or more coil forming machines or coilers 30, which forms the individual coil springs 12 out of wire, one or more conveyors 40 on which coils 12 formed by the coil former 30 are placed, a transfer station 50 at which a row 14 of coils 12 is transferred from the conveyor 30, and a spring interior assembly machine 60 to which the rows 14 of coils 12 are transferred at the transfer station 50 and assembled into the spring interior assemblies 10. Each of the components has a programmed controller, or other control circuitry or control system 31, 41, 51 and 61, respectively, that are preferably linked together through a master control either logically or by way of a master programmed controller 21. The master controller 21 may be provided only by logic in each of the controllers 31, 41, 51 and 61 to exchange and respond to timing signals from the others of the controllers. In most embodiments of the production line 20, most components are conventional, and in some embodiments, all are conventional, except for the manner in which they are operated or the controllers that operate them.

Figure 3:
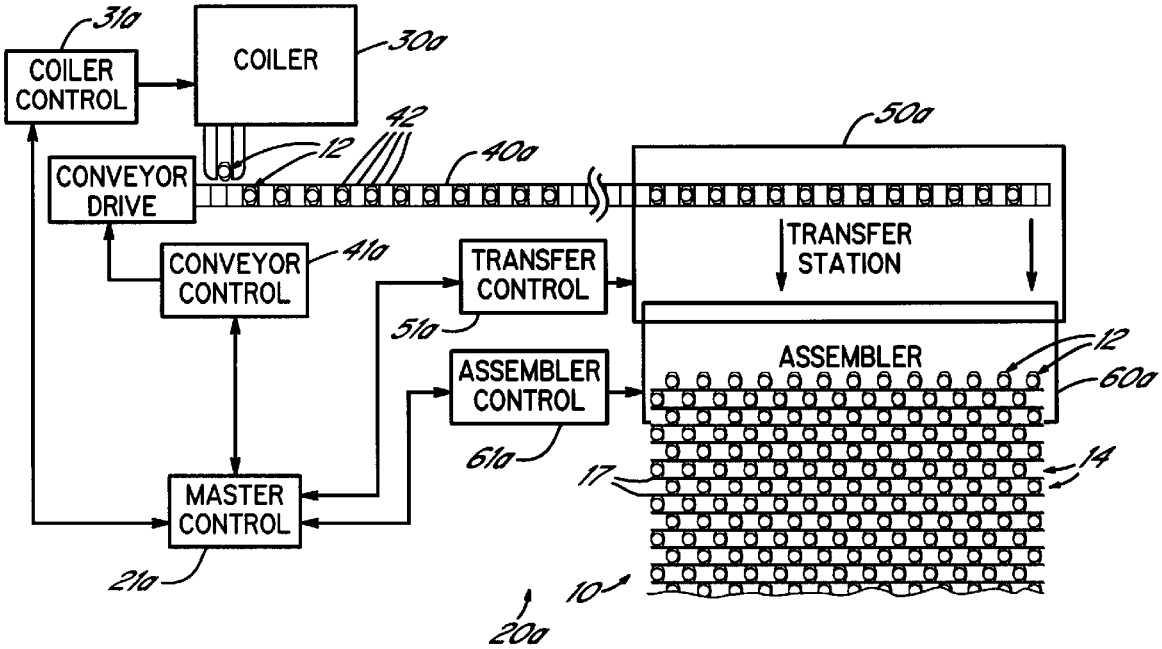
FIG. 3 is a diagrammatic representation of one embodiment of the assembly line of FIG. 2.

In FIG. 3, an embodiment 20*a* of the production line 20 for making a low density spring interior 10 is illustrated, which includes a conveyor 40*a* having a plurality of spring holding locations 42 thereon. The conveyor 40*a* may be conventional provided it is capable of supporting coils 12 selectively at each of the locations 42 so that the coils 12 may be placed on the conveyor 40*a* at alternate locations 42 at a coiler 30*a*. The coiler 30*a* may be a conventional version of the coiler 30 to deliver one coil 12 per cycle of operation and to deposit the coil 12 at a location 42 on the conveyor 40*a* in response to a timing signal from the master controller 21*a*, or may be modified so as to skip alternate cycles so that alternate locations 42 on the conveyor 40*a* are occupied with springs 12 while the intervening locations 42 are left empty. The master controller 21*a* or the conveyor controller 41*a* may alternatively be configured or programmed to index the conveyor 40*a* one location per cycle of the coiler 30*a* or two locations per cycle of the coiler 30*a*. In all other respects, the embodiment 20*a* may include a transfer station 50*a* and related transfer station controller 51*a* and an assembler 60*a* and related assembler controller 61*a* that function in the same manner as they would to produce a standard density spring interior assembly having coils 12 at all of the positions 13. In the various versions of the embodiment 20*a*, the conveyor 40*a* is caused to index one additional location 42 for each alternate row so that the alternate coils 12 and empty ones of the locations 13 are staggered when transferred to the assembler 60*a* at the transfer station 50*a*.

Figure 4:
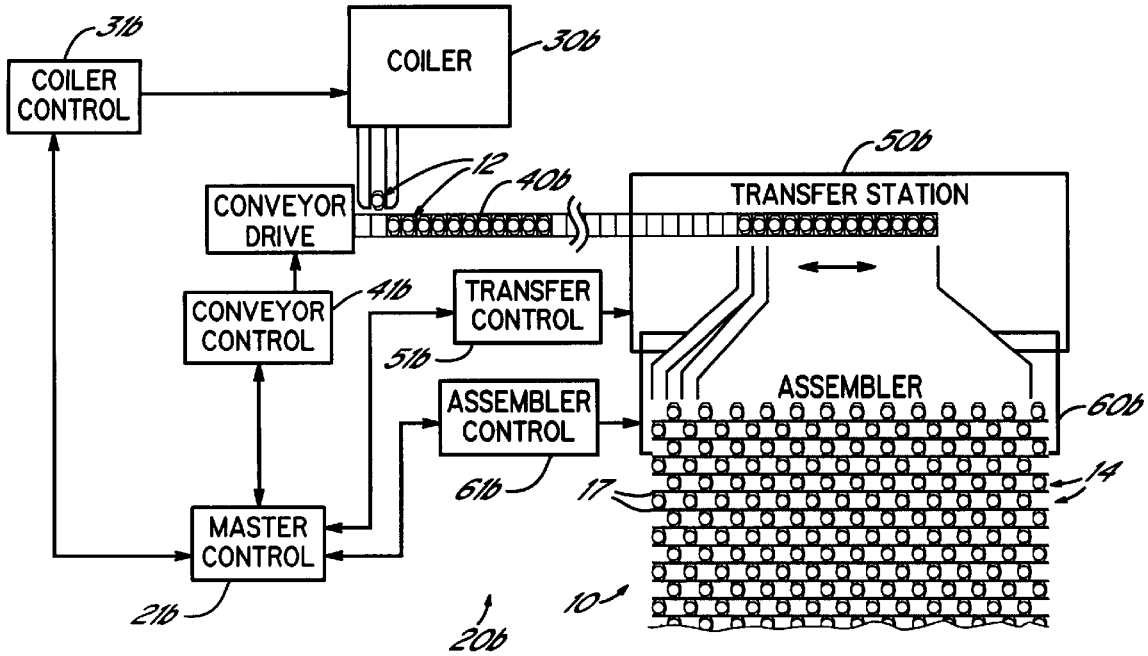
FIG. 4 an alternative embodiment of the spring assembly system of FIG. 3.

Alternatively, an embodiment 20*b* of the production line 20 may be employed to make the low density spring interior 10 as illustrated in FIG. 4. In the embodiment 20*b*, the spring coiler 30*b* and its controller 31*b* may be conventional as may be the conveyor 40*b* and its controller 41*b*, with the master controller 21*b* operating the coiler 30*b* and conveyor 40*b* to fill adjacent positions 42*b* on the conveyor 40*b* with half as many coils 12 as there are positions 13 in a row 14. That is, the coiler 30*b* and conveyor 40*b* operate as if the rows 14 of coils 12 of the spring interior assembly 10 are only half as wide. In the embodiment 20*b*, however, the transfer station operates to remove the adjacent coils 12 from adjacent locations 42*b* on the conveyor 40*b* and spreads them apart as they are transferred to the assembler 50*b*, at which they arrive spaced apart to occupy alternate positions 13 in the spring interior assembly 10 with empty positions 13 between them. In this embodiment 20*b*, only the transfer station 50*b* component is nonconventional. All rows of coils conveyed on the conveyor 40*b* to the transfer station 50*b* can be the same as they would in a production line for producing standard density assemblies, except that there are fewer coils per row 14.

Figure 5:
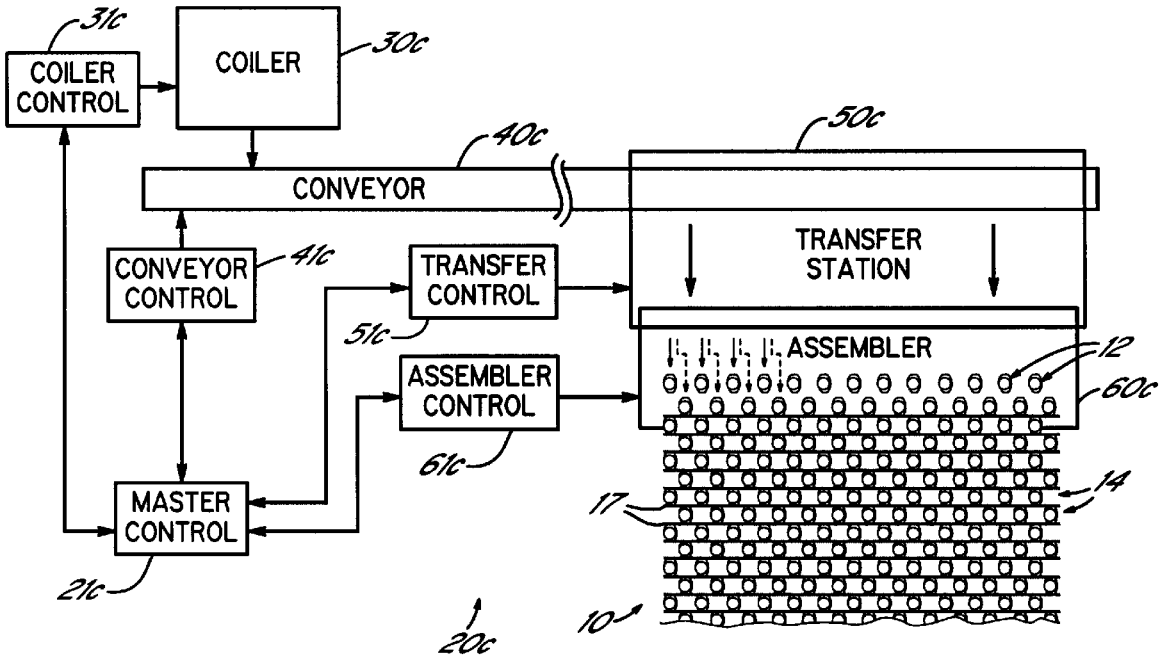
FIG. 5 is a diagrammatic representation of another alternative embodiment of the spring assembly system of FIGS. 3 and 4.

In FIG. 5, an embodiment 20*c* of the production line 20 is illustrated. In the embodiment 20*c*, a transfer station 50*c* is provided with the ability to shift the coils 12 one position 13 in the transfer of alternate rows 14 to the assembler 60*c*. In this embodiment 20*c*, only the transfer station 50*b* component need be nonconventional. All rows of coils conveyed on the conveyor 40*b* to the transfer station 50*b* can be the same, without the need to be indexed differently to stagger the coils 12 of adjacent rows 14.

Figure 6:
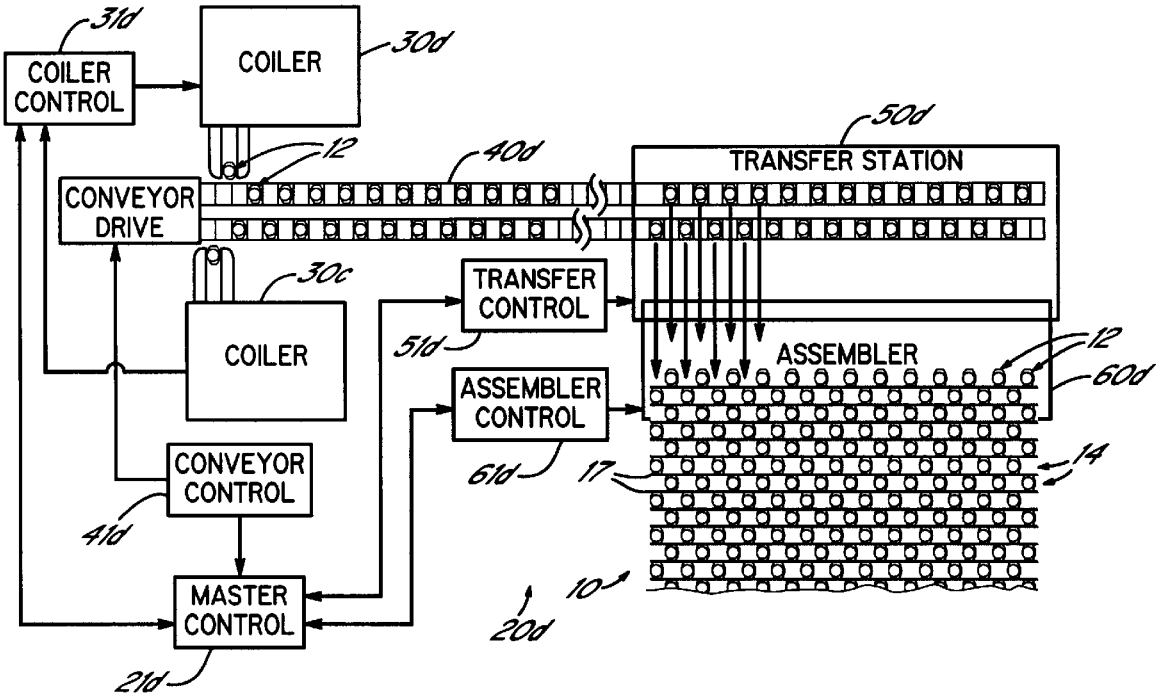
FIG. 6 is a diagrammatic representation of still another embodiment of the spring assembly system of FIGS. 3–5.

In FIG. 6, an embodiment 20*d* of the production line 20 includes two coilers 30*d*, 30*e* and two conveyors 40*d*, 40*e*. The coiler and conveyor combinations are preferably each controlled as in various versions of the embodiment 20*a* with the conveyors 40*d*, 40*e* being indexed differently to offset one row of coils relative to the adjacent row of coils on the conveyors 40*d*, 40*e* as the conveyors transport the arranged rows of coils to the transfer station 50*d*. The transfer station 50*d* may transfer the rows of coils 12 from the conveyors 40*d*, 40*e* in sequence, but preferably, is configured to transfer the two rows simultaneously to the transfer station, with their alternating coils and empty spaces 42*d* in staggered relationship, From the above detailed description of the details of the illustrated embodiments of the invention, those skilled in the art will understand that various modifications and additions may be made thereto without departing from the principles of the present invention.

Therefore, the following is claimed:

1. Method of making low density spring interior assemblies comprising the steps of:

sequentially forming individual coil springs on a coil forming machine;

sequentially placing the individual coil springs at different positions along the length of a conveyor;

advancing the coil springs on the conveyor to a transfer station;

simultaneously transferring a plurality of the individual coil springs sufficient to form a transverse row of coil springs of a spring interior assembly from the conveyor at the transfer station to a spring interior assembly machine;

within the spring interior assembly machine, supporting the transferred plurality of coil springs of the row in a transverse row having a plurality of spring positions that is greater in number than said plurality of transferred coil springs such that a plurality of empty coil spring positions lie transversely adjacent positions occupied by coil springs of the transferred plurality; and lacing the supported plurality of coil springs of the transferred row of coil springs to a previously transferred plurality of coil springs of a different row with coil springs of the previously transferred plurality of coil springs occupying positions that are longitudinally adjacent empty positions of the transferred row of supported plurality of coil springs.

2. The method of claim 1 wherein the supporting and lacing steps include the step of:

supporting coil springs of each of a plurality of rows in alternating positions of each respective row with one of the empty positions between pairs of coil springs of each said respective row and with each of the coil springs of each respective row longitudinally adjacent empty positions of a previously transferred row; and lacing the coil springs of said plurality of rows together in a staggered rectangular array of longitudinally and transversely alternating occupied and empty positions.

3. The method of claim 1 further comprising:

controlling the timing of at least one of the coil forming machine, the conveyor, the transfer station or the spring interior assembly machine to affect the locations of the occupied positions and empty positions in which the springs are supported in the assembly machine.

4. The method of claim 1 further comprising:

controlling the timing of the coil forming machine and the conveyor to create a row of alternating occupied and empty coil spring positions on the conveyor prior to the coil springs arriving at the transfer station.

5. The method of claim 1 further comprising controlling the timing of the conveyors and the transfer station to create a row of alternating occupied and empty coil spring positions in the transfer station from a row of continuously coil spring occupied positions on the conveyor.

6. A method of making low density spring interior assemblies comprising the steps of:

sequentially forming individual coil springs on a first coil forming machine;

sequentially forming individual coil springs on a second coil forming machine;

sequentially placing the individual coil springs from the first coil forming machine at different positions along the length of a first conveyor;

sequentially placing the individual coil springs from the second coil forming machine at different positions along the length of a second conveyor, advancing the coil springs on the first and second conveyors to a transfer station;

transferring to a spring interior assembly machine from each of the first and second conveyors at a transfer station a plurality of the individual coil springs sufficient to form a transverse row of coil springs of a spring interior assembly;

within the spring interior assembly machine supporting the transferred plurality of coil springs from each of the conveyors in a transverse row having a plurality of spring positions that is greater in number than said plurality of transferred coil springs in the row such that a plurality of empty coil spring positions lie transversely adjacent positions occupied by coil springs of the row; and lacing the supported plurality of coil springs of a first transferred row of coil springs to an adjacent transferred plurality of coil springs of a different row with coil springs of the first transferred row of coil springs occupying positions that are longitudinally adjacent empty positions of the adjacent row of coil springs.

* * * * *